US007893374B2

(12) United States Patent
Aihara et al.

(10) Patent No.: US 7,893,374 B2
(45) Date of Patent: Feb. 22, 2011

(54) SHEET SWITCH MODULE

(75) Inventors: Kenshi Aihara, Fujiyoshida (JP); Isao Miyashita, Fujiyoshida (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 291 days.

(21) Appl. No.: 12/172,200

(22) Filed: Jul. 11, 2008

(65) Prior Publication Data

US 2009/0014305 A1 Jan. 15, 2009

(30) Foreign Application Priority Data

Jul. 13, 2007 (JP) ..... 2007-183817

(51) Int. Cl.
*H01H 9/00* (2006.01)

(52) U.S. Cl. ..... 200/314; 200/317; 362/621; 362/628

(58) Field of Classification Search ..... 200/314, 200/317

See application file for complete search history.

(56) References Cited

U.S. PATENT DOCUMENTS 4,449,024 A * 5/1984 Stracener ..... 200/317
5,568,367 A * 10/1996 Park ..... 362/109
6,644,822 B2 * 11/2003 Kumagai ..... 362/26
6,930,263 B2 * 8/2005 Hung ..... 200/61.62
6,997,572 B2 * 2/2006 Ono et al. ..... 362/24
7,188,989 B2 3/2007 Miyashita
7,350,285 B2 * 4/2008 Mitsuoka et al. ..... 29/622
2009/0107816 A1 * 4/2009 Chen et al. ..... 200/314

FOREIGN PATENT DOCUMENTS

JP 2007-53063 A 3/2007

* cited by examiner

*Primary Examiner*—Renee S Luebke
*Assistant Examiner*—Lisa Klaus
(74) *Attorney, Agent, or Firm*—Browdy and Neimark, PLLC

(57) ABSTRACT

A sheet switch module includes a circuit board (20) provided with a fixed contact (22) thereon, a light source (30), a movable contact (26) to face the fixed contact (22), a sheet (28) to hold the movable contact (26) on the circuit board, a key top (46) disposed to face the movable contact and a light guiding plate (32) to guide light emitted from the light source (30) to the key top. The light-guiding plate (32) includes a light-receiving part (34) projecting toward an upper surface of the circuit board (20) and a light-guiding part (39). The light-guiding plate (32) is positioned in a substantially horizontal state supported by the light-receiving part (34) on the upper surface of the circuit board (20).

20 Claims, 5 Drawing Sheets

SHEET SWITCH MODULE

CROSS-REFERENCE TO THE RELATED APPLICATION

This application is based on and claims priority from Japanese Patent Application No. 2007-183817, filed on Jul. 13, 2007, the entire contents of which are hereby incorporated by reference.

BACKGROUND OF THE INVENTION

1. Field of the Invention

The present invention relates to a sheet switch module used in small electronic devices or the like such as mobile phones.

2. Description of the Related Art

A conventional key switch used in small electronic devices or the like includes, as shown in FIG.5, a circuit board 2, a plurality of switches 10 provided on an upper surface of the circuit board 2, a plurality of light sources 8 mounted on the upper surface of the circuit board 2, and a light-guiding plate 12 disposed to cover the switches 10 (for reference, see Japanese Patent Application Publication No. 2007-53063, in particular FIG. 9).

Each of the switches 10 includes a fixed contact 4 mounted on the upper surface of the circuit board 2 and a movable contact 6 which is disposed to cover the fixed contact 4 and comprises a tact spring. A key top 14 is provided above each of the switches 10. Light emitted from each of the light sources 8 enters the light guiding-plate 12, thereby each key top 14 is illuminated by light emitted from the light guiding plate 12.

In the aforementioned key switch, because the light-guiding plate 12 is merely placed above the switches, a large gap or displacement tends to occur between each switch 10 and the light-guiding plate 12, and the light-guiding plate 12 and each key top 14, and it is difficult to align each switch 10 and each key top 14, because of a displacement is generated therebetween. Consequently, there is a problem that efficiency of light guided from the light source 8 through the light guiding plate 12 to each key top 14 is reduced.

To overcome this, there has been proposed a structure in which a light-guiding sheet 16 is disposed to cover an upper surface of the movable contact 6 and an upper surface of the circuit board 2 and adhered thereto through an adhesive 18 (for reference, see FIG. 1 or the like of above-mentioned Japanese Patent Application Publication No. 2007-53063). In this way, when the light-guiding sheet 16 is closely fitted to each of the switches 10 and so on, and adhered thereto, a displacement between each switch and the corresponding key top is avoided, and a gap between the light-guiding sheet 16 and each switch 10 or light sources 8 is avoided.

However, in the conventional technology disclosed in above-mentioned Japanese Patent Application Publication No. 2007-53063, the light-guiding sheet 16 tends to curve at a boundary between the upper surface of the movable contact 6 and the upper surface of the circuit board 2, light is diffused at the curved portion thereby generating loss of the light, and there is a problem that light-guiding efficiency throughout the entire light-guiding sheet is reduced.

SUMMARY OF THE INVENTION

An object of the present invention is to provide a sheet switch module configured to arrange a light guiding plate in a horizontal (level) state, guide efficiently light emitted from a light source and prevent the generation of a displacement or gap between the light-guiding plate and other parts.

To accomplish the above object, a sheet switch module according to one embodiment of the present invention includes a circuit board, at least one switch mounted on an upper surface of the circuit board, at least one light source mounted on the upper surface of the circuit board; and a light-guiding plate including at least one light-receiving part and a light-guiding part which is disposed above the switch, the at least one light-receiving part each extended from a lower surface of the light-guiding part toward the upper surface of the circuit board, and the at least one light-receiving part supporting the light-guiding plate on the upper surface of the circuit board. Further, the light-guiding part has a thickness thinner than a height of the light source and the each of the at least one light-receiving part has a portion thicker than the height of the light source.

Also, the at least one light-receiving part each has a concavely curved lower surface which extends from the lower surface of the light-guiding part, and a convexly curved surface connected to the concavely curved lower surface at a lowest position adjacent to the upper surface of the circuit board.

In addition, the light-guiding part has at least one protrusion on the lower surface of the light-guiding part at a position which corresponds to each of the at least one switch on the upper surface of the circuit board. The at least one light-receiving portion and the at least one protrusion which project from the lower surface of the light-guiding plate support the light-guiding plate on the upper surface of the circuit board.

Each of switches includes at least one fixed contact fixed to the upper surface of the circuit board and at least one movable contact each disposed over the corresponding fixed contact and attached to the upper surface of the circuit board at a peripheral edge of the movable contact.

The sheet switch module further includes a sheet disposed on an upper surface of the at least one movable contact and fixing the at least one movable contact to the upper surface of the circuit board.

The sheet switch module further includes a key top sheet disposed above the light guiding plate and including at least one key top each at a position facing each of the at least one switch, and the light guiding plate is disposed between the key top sheet and the switch.

The sheet switch module has the at least one light-receiving part each has a configuration to collect light emitted from the light source.

The sheet switch module has the at least one light-receiving part each fixed to the upper surface of the circuit board at a lowest part of the light-incident part by a first adhesive layer.

The sheet switch module has the light-guiding plate having at least one protrusion, and a lowest part of the at least one protrusion fixed to a top portion of the sheet at a positions where each switch is disposed under the sheet. The lowest part of the protrusion is fixed to the top portion by a second adhesive layer.

The sheet switch module further includes a light-shielding sheet adhered to the upper surface of the light guiding plate at an area facing the light-receiving part.

The sheet switch module further includes a light-shielding layer provided on the upper surface of the sheet adjacent to the light-receiving part.

DETAILED DESCRIPTION OF THE INVENTION

Preferred embodiments of the present invention will be explained in detail hereinafter with reference to the accompanying drawings.

Figure 1:
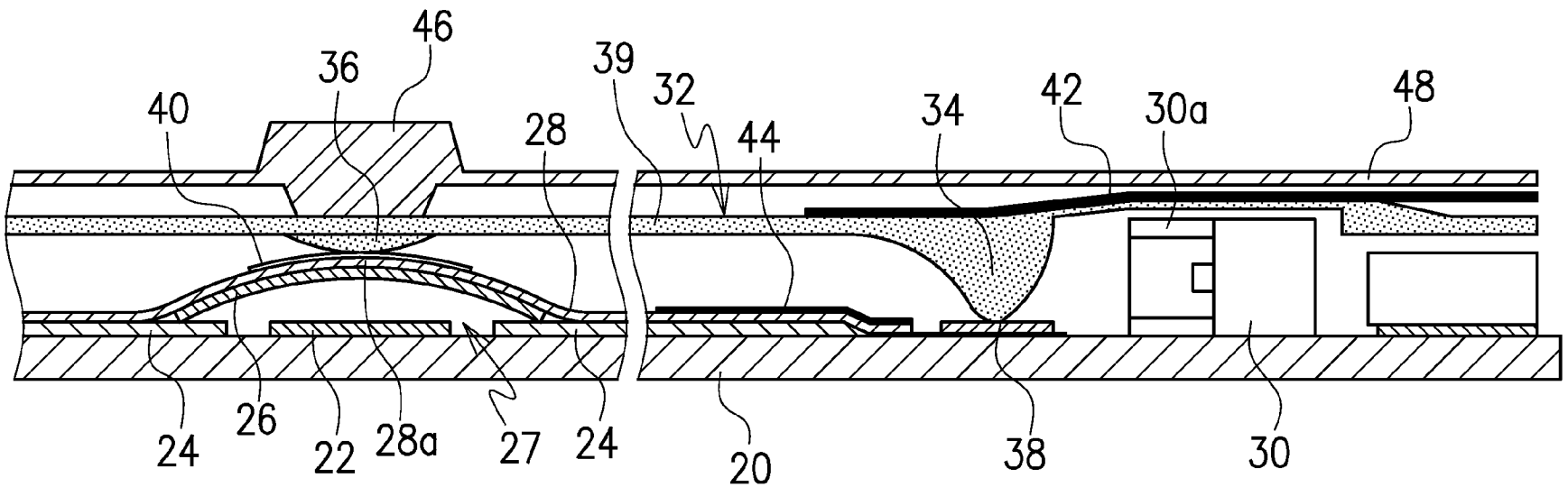
FIG. 1 is a sectional view showing a part of a sheet switch module according to one embodiment of the present invention.

FIG. 1 illustrates a sheet switch module according to one embodiment of the present invention.

The sheet switch module in this embodiment includes a circuit board 20 formed by a flexible circuit board or the like and at least one switch 27 mounted on the circuit board 20. In the illustrated embodiment, a plurality of switches are provided on un upper surface of the circuit board 20. In this embodiment, each of the switches 27 includes a fixed contact 22 disposed on the upper surface of the circuit board 20 and a movable contact 26 which has a dome shape over the fixed contact 22 and has a peripheral edge disposed on and in contact with an electrode pattern 24 on the upper surface of the circuit board 20. The movable contact comprises, for example, a tact spring having a dome shape to achieve an electrical connection between the corresponding electrode pattern 24 and a corresponding fixed contact 22 disposed under the movable contact when pressed from above.

The sheet switch module also includes a thin material 28 formed in a shape of sheet or film and adhered to upper surfaces of the circuit board 20 and the movable contacts 26 along upper external shapes thereof. The sheet or film 28 acts to securely attach the movable contact 26 to the upper surface of the circuit board 20.

It should be noted that any other suitable members capable of attaching securely the movable contacts 26 to the upper surface of the circuit board 20 may be used.

The sheet switch module further includes a plurality of key tops 46 each of which is disposed above each of the switches 27 and a lower part of each of the key tops 46 is configured to press the switch 27 from above, at least one light source such as light-emitting diode (LED) 30 which comprises at least one LED element mounted on the upper surface and at a peripheral part of the circuit board 20, and a light-guiding plate 32 formed in a shape of sheet or film which receives light emitted from at least one LED 30 disposed at a periphery thereof and guides the received light to the key tops 46. The key tops 46 are integrally formed with a key-top sheet 48, which is described hereinafter.

Figure 2:
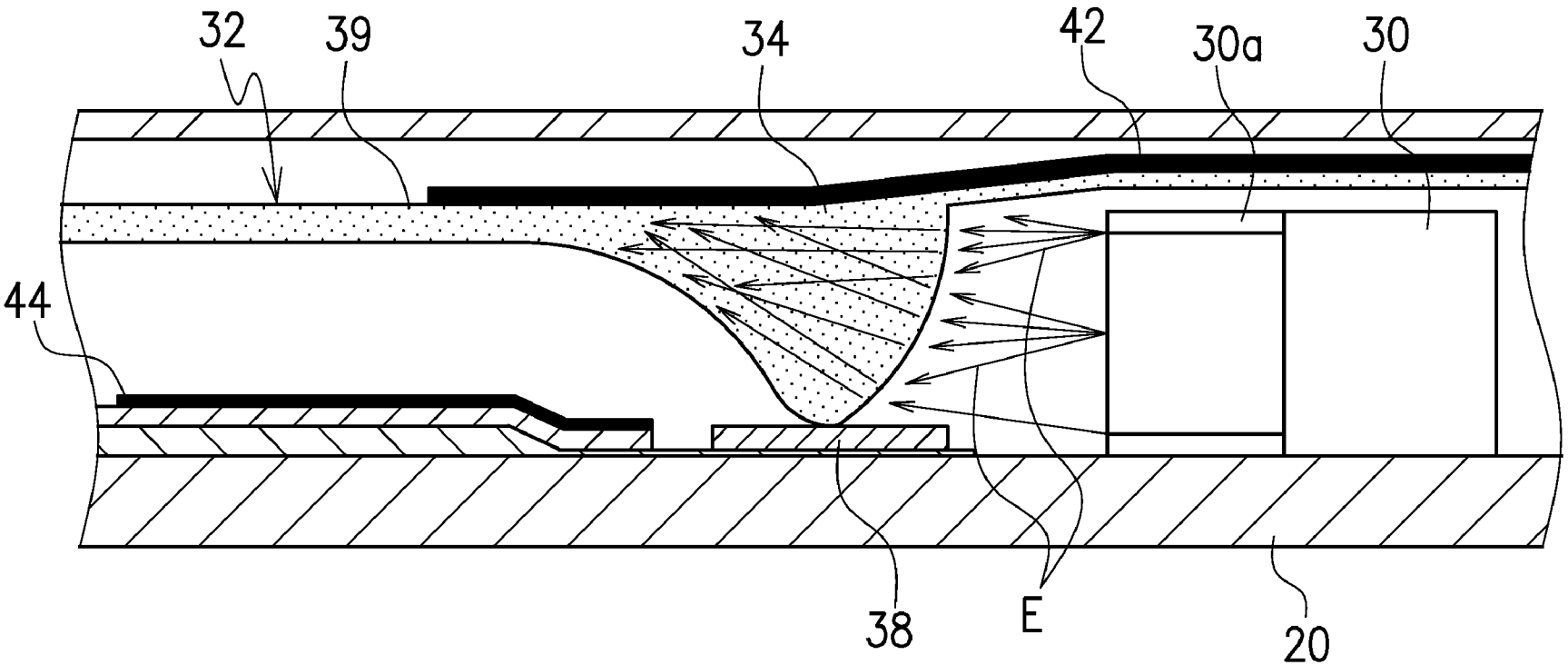
FIG. 2 is an enlarged view of a main section of the sheet switch module shown in FIG. 1.

In the illustrated embodiment, a plurality of LEDs are mounted on the upper surface of the circuit board 20, and each of the LEDs emits light in a direction parallel to an upper surface of the circuit board 20 and may have a reflection frame 30*a* configured to make lights toward a corresponding light-receiving part 34 of the light-guiding plate 32, in other words, in an emission direction E (see FIG. 2). The reflection frame 30*a* in this embodiment is disposed on at least upper and lower part of an emission section resin which seals the at least one LED elements.

On the other hand, the light-guiding plate 32 is made of a material having an excellent light-guiding or light-transmitting property such as acryl resin, silicone resin, polycarbonate resin, polyethylene terephthalate resin, urethane resin, and so on. In one embodiment, the light-guiding plate 32 includes a plurality of light-receiving parts 34 each of which is configured to receive light emitted from the corresponding LED and a light-guiding part 39 configured to guide the light received at the light-receiving parts 34. The light-guiding part has a thickness thinner than a height of the light source and the light-receiving part including a portion whose thickness is thicker than the height of the light source. Each of the light-receiving parts 34 has a concavely curved lower surface integrally extending from a lower surface of the light guiding part 39 to the upper surface of the circuit board, and has a convexly curved surface which is connected to the concavely curved lower surface at a position adjacent to the upper surface of the circuit board and extended upward to at least a height of the lower surface of the light-guiding part and extended over an upper surface of the LEDs 30 in a cross-sectional view of FIG. 1. Each of the light-receiving parts 34 has at a surface facing the corresponding LED 30 the convexly curved surface facing a front surface of the LED and at a side facing the at least one switch a concavely curved surface which is gently depressed toward a side of the LED 30.

The light-guiding plate 32 is positioned in a horizontal or level state supported by each of the light-receiving parts 34 extending to an upper surface of the circuit board 20 and the lower surface which are disposed on top portions 28*a* of the sheet material 28.

Figure 3:
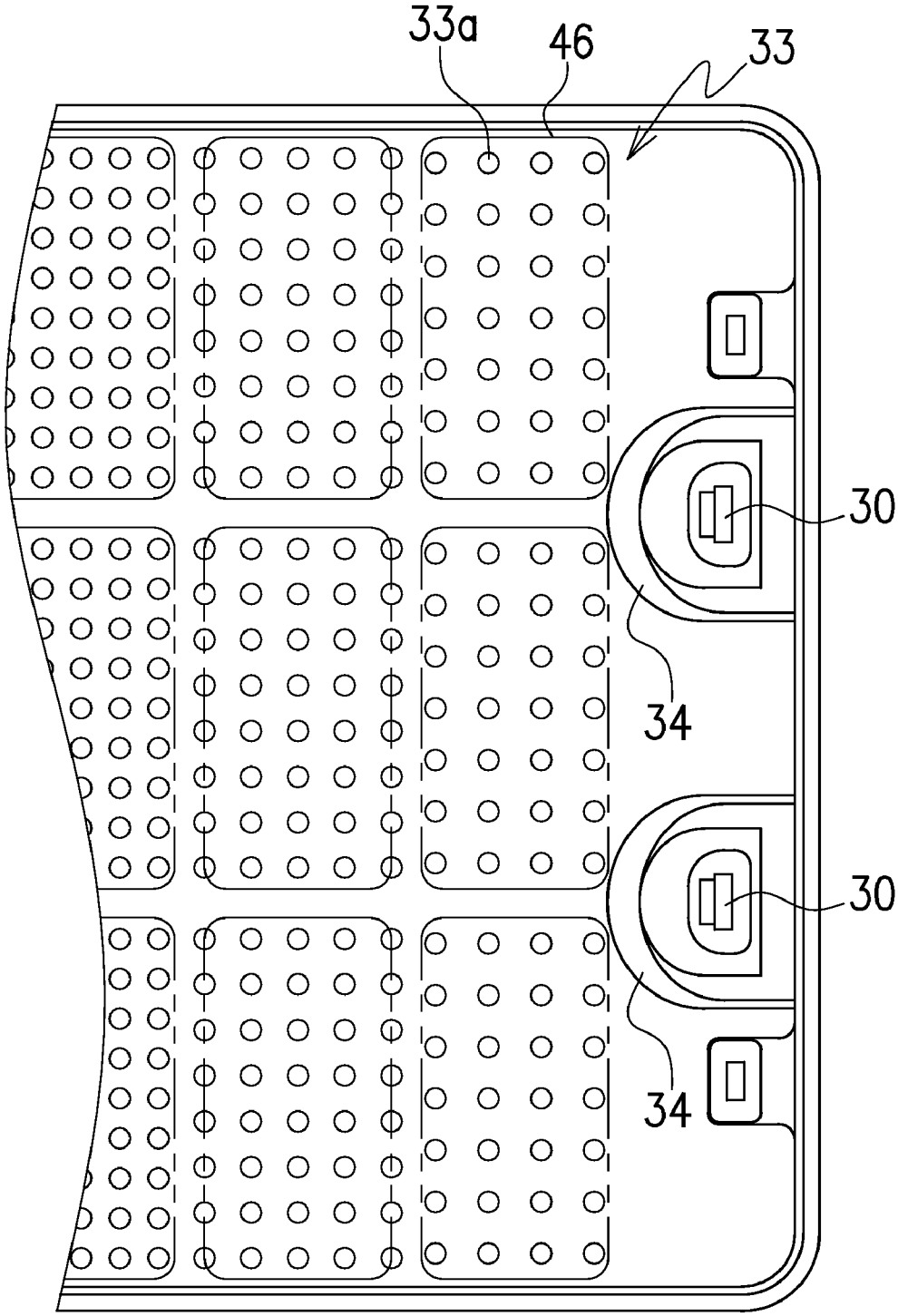
FIG. 3 is a plan view of a part of the sheet switch module shown in FIG. 1.

Each of the light-receiving parts 34 in the embodiment has an approximately crescent-like shape which is disposed to face and surround each of light-emitting surfaces the LEDs 30, as shown in FIGS. 1 and 2 and formed to surround the emission direction in a generally semi-circular shape, as viewed from above, as shown in FIG. 3.

Each of the light-receiving parts 34 also works as a lens to focus light, similar to a convex lens and is configured to collect lights from each of the LEDs 30 and allow the collected lights to be transmitted through the light-guiding plate 32.

In addition, the light-guiding plate 32 in the embodiment includes a plurality of protrusions 36 each of which is provided at a position facing a top portion 28*a* of the sheet 28 opposing an apex of each of the movable contacts 26 and has a shape similar to a part of a sphere. The protrusions 36 may be formed, for example, by printing resin on the lower surface of the light-guiding plate 32.

In FIG. 1, reference number 38 shows a first adhesive layer disposed to face each of the light-receiving parts, and reference number 40 a second adhesive layer disposed to face each of the top portions 28*a* of the sheet material 28. The first adhesive layer 38 is provided on the upper surface of the circuit board 20 to fix a lowest part of the light-receiving part 34 to the upper surface of the light-guiding plate 32. The second adhesive layer 40 is configured to fix a lowest part of each of the protrusions 36 to each of the top portions 28*a* of the sheet 28 at a position where each of the switches is provided under the sheet 28.

In FIG. 1, reference number 42 shows a light-shielding sheet which is adhered to the upper surface of the light-guiding plate 32 at an area above LEDs 30 and light-receiving parts 34. Reference number 44 shows a light-shielding layer formed on an upper surface of the sheet 28 by printing, for example, and the light-shielding layer 44 is disposed at an area adjacent to each light-receiving part 34 and opposite to the corresponding LED 30 (see FIGS. 1 and 2).

In the sheet switch module structured as described above, the aforementioned key top sheet 48 provided with the key tops 46 each of which is disposed at a position corresponding to each of the switches 27 is disposed on the light-guiding plate 32. Here, it should be noted that the key top sheet 48 is disposed above the light-guiding plate 32 in such a manner that the key tops 46 are disposed facing the switches 27, respectively.

In this embodiment, the key top sheet 48 has a light-transmitting property at key tops 46, at least. Each of the key tops 46 is lighted up by transmitted light through the light-guiding plate 32. Therefore, light-diffusing parts 33, each formed by a plurality of dots 33*a* are preferably provided at portions of an upper or lower surface of the light-guiding plate 32 at positions facing the key tops 46, as shown in FIG. 3. The light being transmitted through the light-guiding plate 32 is diffused by the dots 33*a* to illuminate the key tops 46.

Figure 4:
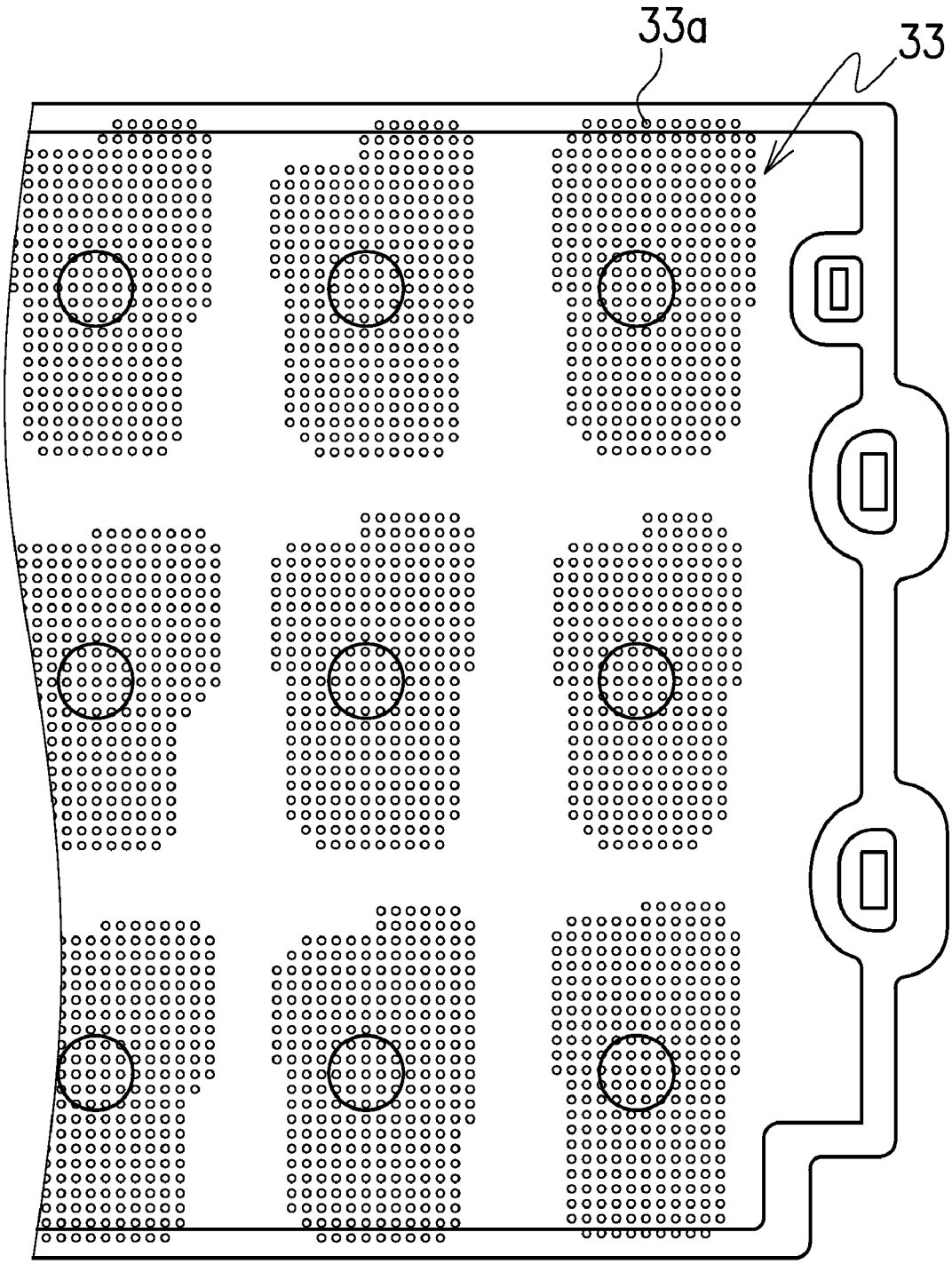
FIG. 4 is a plan view of a portion of the sheet switch module, showing one example of dot arrangement.
Figure 5:
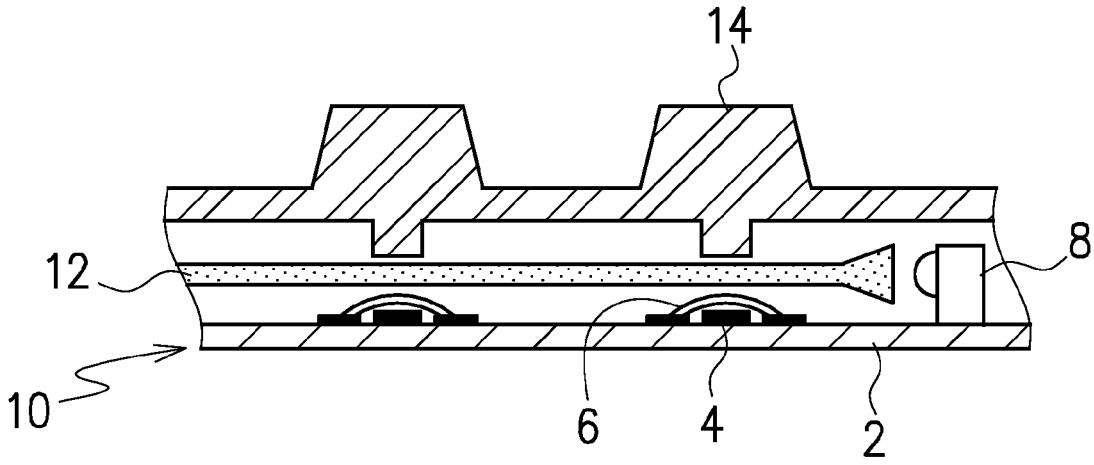
Fig. 5 (Background Art)
FIG. 5 is a sectional view showing a structure of a conventional key switch.
Figure 6:
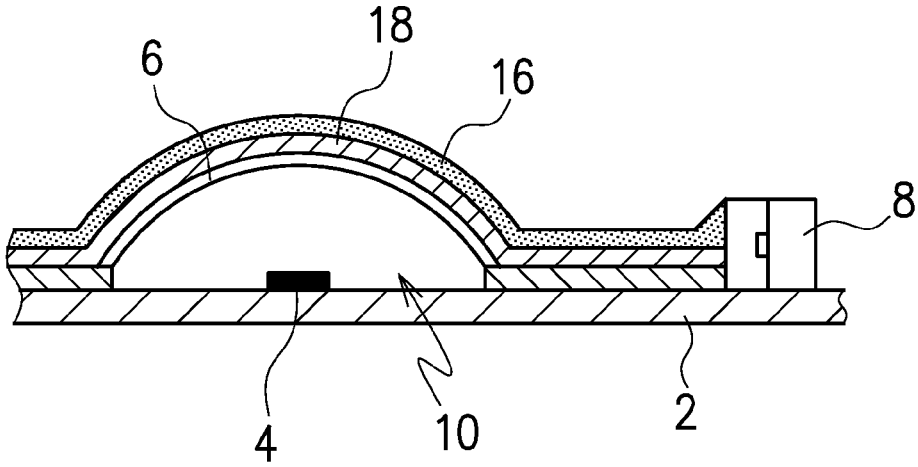
Fig. 6 (Background Art)
FIG. 6 is a sectional view showing a structure of another conventional key switch.

The dots 33*a* in the embodiment are structured to form gradation patterns having increasing density of dots with increasing distance from the LEDs 30 to obtain uniform emission. Also, the dots 33*a* can be formed by any one or any combination of transparent, semi-transparent and white printings. In this way, when combining the transparent, semi-transparent and white printings to obtain the uniform emission, the number and the density of the dots 33*a* are set to be constant, and the transparent, semi-transparent and white dots 33*a* are arranged in order according to distance from the LED 30, as shown in FIG. 4.

The light-guiding plate 32 in the sheet switch module is supported by the light-receiving parts 34 extended from the lower surface of the light-guiding plate 32 to the upper surface of the circuit board and the protrusions 36 which are provided on the lower surface of the light-guiding portion and disposed on the top portions 28*a* of the sheet material 28. As mentioned above, because the height of each of the light-receiving parts 34 is set to have the similar height to an added height of each of the top portions 28*a* (from the upper surface of the circuit board 20) and a protrusion 36, the light-guiding plate 32 is supported in a generally horizontal (level) state. Because the light-guiding plate 32 is supported in the horizontal state in this way, the light-guiding part 39 is kept straight and stable, the light introduced into the light-guiding plate can be guided efficiently to the key tops 46.

In addition, since the light-guiding plate 32 is supported in the horizontal state, gaps or displacements do not occur even when a lower surface of each of the key tops 46 is not adhered to the upper surface of the light-guiding portion. As a result, since a lower surface of the key top sheet 48 is adhered to the upper surface of the light-guiding plate at portions away from the key tops 46, therefore, it is possible to enhance the operational feeling of pressing each key top 46 and prevent occurrence of abnormal sounds when the key top 46 comes into contact with the top portion of the sheet material 28.

It should be noted that, because the light-guiding plate 32 is disposed in the horizontal state, the key top sheet 48 can be disposed above the light-guiding plate 32 in a state where each key top 46 is in contact with the light-guiding plate 32 even if the key top 46 is not adhered to the light-guiding plate 32. It is possible to fix the key top sheet 48, except for parts thereof with key tops 46, by adhering it to the light-guiding plate 32, the circuit board 20 or the like. Because the key top 46 is in close contact with the switch 27 without adhesively attaching the key top and the switch, it is possible to prevent degradation of click feeling of the switch 27.

In addition, in the embodiment, the protrusion 36 is provided on the lower surface of the light-guiding part 39 contacting with the top portion 28*a* of the sheet material 28 to enhance pressing operational feeling and allow adjustment of the height of the light-guiding plate compared to the height of the light-receiving part 34, but the lower surface of the light-guiding plate 32 may be attached directly to the top portion 28*a* of the sheet material, without providing the protrusion 36.

On the other hand, it should be noted that the light-receiving part 34 of the light-guiding plate 32 is formed in a lens shape facing the LED 30, as shown in FIG. 2. Thereby, because the light-receiving part 34 can efficiently collect the light emitted from the LED 30 and introduce it therein, the light-guiding plate 32 can receive the light emitted from the LEDs 30 at a wide angle, collect the light in a parallel or shallow angular direction to the upper or lower surface of the light-guiding plate 32 and introduce the collected light therein.

Although a part of the light-receiving part 34 may appear to light up unevenly without the light-shielding sheet 42 and the light-shielding layer 44, with the light-shielding sheet 42 and the light-shielding layer 44, it is possible to prevent uneven light from appearing.

The horizontal support manner of the light-guiding plate 32 prevents a shape of the light-guiding plate from distorting or deforming, as mentioned above. Consequently, it is possible to prevent displacement of the light-receiving parts or the light diffusion parts provided on the light-guiding plate and the light sources or the switches.

Moreover, because each of the light-receiving parts is formed in the curved surfaces, it is possible to efficiently receive the light emitted from the LED into the light-guiding plate, and thus, light emission efficiency from the light-guiding plate can be enhanced.

Moreover, because the light-guiding plate has the protrusions provided on the lower surface of the light-guiding part, a lowest part of each of the protrusions contacts with each of the top portions of the sheet, the height of light-guiding part can be adjusted by the height of protrusions, and the light-guiding plate can be firmly maintained in a horizontal state through the height adjustment of the light-receiving parts and the protrusions.

Furthermore, because the height of the light-receiving parts is set to be equal to the added height of each of the top portions and the corresponding protrusion, the light-guiding plate can be supported over its entirety.

In addition, because the lowest part of each light-receiving part and the upper surface of the circuit board are fixed by the first adhesive layer, and the lowest parts of the light-guiding plate and the top portion of the sheet facing each of the movable contacts are fixed by the second adhesive layer, displacement between each movable contact, the light-guiding plate and the key top facing the movable contact can be prevented.

Although the preferred embodiments of the present invention have been described, it should be understood that the present invention is not limited to these embodiments, and various changes and modifications can be made to the embodiments.

INDUSTRIAL APPLICABILITY

The support structure of the light guiding plate in the sheet switch module according to the present invention can be employed not only in the illumination of a switch, but also in a backlight device or the like of a meter display or the like.

What is claimed is:

1. A sheet switch module, comprising:

a circuit board;

at least one switch mounted on an upper surface of the circuit board;

at least one light source mounted on the upper surface of the circuit board; and a light-guiding plate including at least one light-receiving part that is extended from a lower surface of the light-guiding plate and including a light-guiding part that is disposed above the at least one switch, the at least one light-receiving part each having a concavely curved surface and a convexly curved surface that is connected to the concavely curved surface at a position adjacent to the upper surface of the circuit board, and the at least one light-receiving part supporting the light-guiding plate on the upper surface of the circuit board.

2. The sheet switch module according to claim 1, wherein the light-guiding part has a thickness thinner than a height of the at least one light source and the each of the at least one light-receiving part has a portion thicker than the height of the at least one light source.

3. The sheet switch module according to claim 1, wherein the light-guiding part has at least one protrusion on the lower surface of the light-guiding part at a position that corresponds to each of the at least one switch mounted on the upper surface of the circuit board.

4. The sheet switch module according to claim 3, wherein the at least one light-receiving part and the at least one protrusion that projects from the lower surface of the light-guiding plate support the light-guiding plate.

5. The sheet switch module according to claim 1, wherein the at least one switch each includes at least one fixed contact fixed to the upper surface of the circuit board and at least one movable contact each disposed over the corresponding fixed contact and attached at the movable contact's peripheral edge to the upper surface of the circuit board, and the sheet switch module further comprising a sheet that fixes the at least one movable contact, the sheet disposed on the upper surface of the circuit board and covering the at least one movable contact, and wherein a lowest part of the at least one protrusion as recited in claim 3 is fixed to a top portion of the sheet covering the at least one movable contact.

6. The sheet switch module according to claim 5, wherein a lowest part of the at least one protrusion each is fixed to a top portion of the sheet at a positions where each switch is disposed under the sheet.

7. The sheet switch module according to claim 6, wherein the lowest part of the at least one protrusion is fixed to the top portion of the sheet by an adhesive layer.

8. The sheet switch module according to claim 5, further comprising a light shielding layer provided on the upper surface of the sheet fixing the at least one movable contact and disposed on the upper surface of the circuit board at a position of the sheet adjacent to the light-receiving part.

9. The sheet switch module according to claim 1, further comprising a key top sheet disposed above the light-guiding plate and including at least one key top each at a position facing each of the at least one switch, wherein the light-guiding plate is disposed between the key top sheet and the switch.

10. The sheet switch module according to claim 1, wherein the at least one light-receiving part each has a configuration to collect light emitted from the light source.

11. The sheet switch module according to claim 1, wherein the at least one movable contact each has a substantially dome shape.

12. The sheet switch module according to claim 1, wherein a lowest part of each of the at least one light-receiving part is fixed to the upper surface of the circuit board by an adhesive layer.

13. The sheet switch module according to claim 1, further comprising a light shielding sheet adhered to the upper surface of the light guiding plate at an area facing the light-receiving part.

14. A sheet switch module, comprising:

a circuit board;

at least one switch mounted on an upper surface of the circuit board;

at least one light source mounted on the upper surface of the circuit board; and a light-guiding plate including at least one light-receiving part and a light-guiding part that is disposed above the at least one switch, the at least one light-receiving part each extended from a lower surface of the light-guiding part toward the upper surface of the circuit board, and the light-guiding part having at least one protrusion on the lower surface of the light-guiding part at a position that corresponds to each of the at least one switch provided on the upper surface of the circuit board.

15. The sheet switch module according to claim 14, wherein the at least one light-receiving portion and the at least one protrusion that projects from the lower surface of the light-guiding plate support the light-guiding plate.

16. The sheet switch module according to claim 14, wherein the at least one switch each includes at least one fixed contact fixed to the upper surface of the circuit board and at least one movable contact each disposed over the corresponding fixed contact and attached at the movable contact's peripheral edge to the upper surface of the circuit board, and the sheet switch further comprising a sheet that fixes the at least one movable contact, the sheet disposed on the upper surface of the circuit board and covering the at least one movable contact, and wherein a lowest part of the at least one protrusion as recited in claim 15 is fixed to a top portion of the sheet covering the at least one movable contact.

17. The sheet switch module according to claim 16, further comprising a light shielding layer provided on the upper surface of the sheet that fixes the at least one movable contact and is disposed on the upper surface of the circuit board, the light shielding layer provided at a position of the sheet adjacent to the light-receiving part.

18. The sheet switch module according to claim 14, further comprising a key top sheet that is disposed above the light-guiding plate and that includes at least one key top each at a position facing each of the at least one switch, wherein the light-guiding plate is disposed between the key top sheet and the at least one switch.

19. The sheet switch module according to claim 14, wherein the at least one light-receiving part is fixed at a lowest part of each of the at least one light-receiving part to the upper surface of the circuit board.

20. The sheet switch module according to claim 14, further comprising a light shielding sheet adhered to the upper surface of the light guiding plate at an area facing the light-receiving part.

* * * * *